United States Patent [19]

Molenaar et al.

[11] 4,171,225

[45] Oct. 16, 1979

[54] ELECTROLESS COPPER PLATING SOLUTIONS

[75] Inventors: Arian Molenaar; Henricus M. Van Den Bogaert; Jan Boven, all of Eindhoven, Netherlands

[73] Assignee: U.S. Philips Corporation, New York, N.Y.

[21] Appl. No.: 898,652

[22] Filed: Apr. 21, 1978

Related U.S. Application Data

[63] Continuation of Ser. No. 757,879, Jan. 10, 1977, abandoned.

[30] Foreign Application Priority Data

Jan. 23, 1976 [NL] Netherlands ..... 7600689

[51] Int. Cl.[2] ..... C23C 3/02

[52] U.S. Cl. ..... 106/1.23; 106/1.26; 427/92; 427/98; 427/305; 427/437

[58] Field of Search ..... 106/1.05, 1.11, 1.13, 106/1.18, 1.22, 1.23, 1.26; 427/92, 98, 305, 306, 437

[56] References Cited

U.S. PATENT DOCUMENTS

| | | | |
|---|---|---|---|
| 3,607,317 | 9/1971 | Schneble, Jr. | 106/1 |
| 3,615,732 | 10/1971 | Shipley, Jr. | 106/1 |
| 3,846,138 | 11/1974 | Gulla | 106/1.26 |
| 4,006,269 | 2/1977 | Kerfoot | 427/98 |

FOREIGN PATENT DOCUMENTS 1330332 9/1973 United Kingdom .

*Primary Examiner*—Lorenzo B. Hayes
*Assistant Examiner*—Amelia B. Yarbrough
*Attorney, Agent, or Firm*—Norman N. Spain

[57] ABSTRACT

Electroless copper plating bath containing a copper salt, a complexing agent, alkali and by way of reducing agent a complex of formaldehyde with an aminocarboxylic acid, -sulphonic acid or -phosphonic acid. Consequently, decomposition of the bath is greatly reduced and furthermore copper of a superior quality is obtained.

4 Claims, No Drawings

ELECTROLESS COPPER PLATING SOLUTIONS

This is a continuation of application Ser. No. 757,879, filed Jan. 10, 1977, now abandoned.

The invention relates to electroless aqueous copper plating solutions.

As a rule electroless copper plating solutions comprise curpic ions, one or more compounds which form a complex with cupric ions and as a rule formaldehyde or a compound which furnishes formaldehyde as a reducing agent. However, the reduction of cupric ions to metal can only take place in an alkaline medium, preferably in the pH-range between 12 and 13.

U.S. Pat. No. 3,615,732 discloses such an alkaline solution by means of which good, ductile copper can be deposited on metal nuclei layers which may have been obtained either chemically or photographically and which act as a catalyst for the copper deposition. In accordance with this patent specification the inclusion of hydrogen during the decomposition reaction of an electroless copper plating bath is prevented and thereby the ductability of the deposited copper is improved by the addition of a compound which furnishes with formaldehyde an addition-product such as a sulfite, a bisulfite or a phosphite. An electroless copper plating bath comprises as essential constituents a soluble cupric salt, alkali for adjusting the pH, one or more complexing agents for cupric ions, formaldehyde or a compound which furnishes formaldehyde and, preferably, also a polyoxyalkylene compound.

An annoying property of formaldehyde is that in an alkaline medium it is subjected to side reactions so that the greater part is lost for a reduction reaction from cupric ions to copper metal $$Cu^{++}+2HCHO+4OH^{-}\rightarrow Cu+2HCOO^{-}+2H_2O+H_2$$

An unwanted side reaction is the so-called Cannizzaro reaction, in which formate is formed according to $$2HCHO+OH^{-}\rightarrow CH_3OH+HCOO^{-}.$$

Besides that the so-called aldol condensation takes place which also contributes to the loss of formaldehyde from the solution.

The above formaldehyde addition products decompose substantially completely in an alkaline medium so that the disadvantage of the occurrence of the above-mentioned side reactions remains. Consequently, when the copper plating baths are used continuously much more formaldehyde must be added than is required for the reaction which is responsible for the copper deposition.

It is an object of the invention to provide a composition of the bath in which the unwanted reactions do not occur anymore or are reduced to such an extent that they are no longer annoying.

The electroless copper plating bath of the composition defined hereinbefore is characterized in that the bath furthermore contains one or more salts of non-bivalent sulphur containing aminoalkylcarboxylic acids, aminoalkylsulphonic acid/or aminoalkylphosphonic acids with at least one free —$NH_2$ group, predominantly in the form of an addition product with formaldehyde via said —$NH_2$ groups and in a quantity which preferably is at the utmost molarly equal to the quantity of formaldehyde present.

The addition compound discussed here is formed in the copper plating solution by adding an aminoacid and the formaldehyde as such. The compound may also be prepared separately outside the plating bath, for example according to the equation

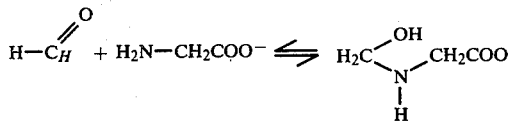

at a pH of over 7.

The presence of the above-said addition product has in the first place the advantage that the undesired Cannizzaro reaction is reduced to a non-annoying level.

By way of illustration two experiments are discussed here. According to the first experiments a solution of 1.5 mol/l formaldehyde-bisulphite compound to which NaOH is added to a pH=12.8 is heated for 5.5 hours at 52° C. According to the second experiment a solution of 1.5 mol of the addition product glycine-formaldehyde with NaOH to pH=12.8 is heated at 60° C. for 6.5 hours. In the first experiment 40% of the formaldehyde is converted into formate and in the second experiment less than 1%. The determination of formate is done by means of proton magnetic resonance (nmr) by measuring the formate proton. In these experiments the $Cu^{++}$ has been omitted from the solution because the paramagnetic $Cu^{++}$ is a disturbing factor in the nmr-determination.

During use the bath according to the invention is replenished by the addition of formaldehyde.

A further advantage of the addition according to the invention is a good quality of the copper deposited therefrom as regards ductability. That this is caused by the presence of amino acids or addition products is the more surprising because in general hydrogen-containing compounds such as urea, pyridine or quarternary ammonium compounds give inferior copper deposits as regards appearance and ductility.

The increased stability of the reducing agent reduces the formation of by-products. Especially the fact that less salt is formed is of very great importance for a production bath which is in continuous operation.

A pleasant additional advantage of the bath according to the invention is that the unpleasant smell of the formaldehyde is substantially not noticeable.

In accordance with the invention the bath contains the addition product formed by the reaction of one or more salts of amino acids having at least one free —$NH_2$ group with formaldehyde in which the grouping —$N^H$—$CH_2OH$ is present.

Compounds with other nitrogen groups such as amides, amines, urea compounds or peptides show no effect or even impair the quality of the deposited copper. Also amino acids which contain bivalent sulphur must not be used because they result in poisoning of the copper surface.

It should be noted that, for example, in the DT-OS No. 2.051.279 glycine is mentioned among a large number of complexing agents for cupric ions in electroless copper plating baths. However, in the copper plating bath according to the invention an other complexing agent is invariably present, while in addition an amino acid in a quantity at least equal to the stoichiometrical proportion with formaldehyde is added.

The presence in the bath according to the invention of one or more polyoxyalkylene compounds, as is known per se from British Patent Specification No. 1.330.332 has an extra favourable effect in combination with the amino acid is a preferred embodiment of the bath according to the invention.

A very interesting preferred embodiment is an electroless copper plating bath having the tetrasodiumsalt of ethylenediaminetetraacetic acid as a complexing agent for cupric ions and glycine to form an addition compound with formaldehyde.

The copper plating bath according to the invention is prepared in such a way that the salts of the aminoalkylcarbozylic acid, -sulphonic acid or -phosphonic acid and the formaldehyde are added separately in quantities wherein the salt preferably is, at the utmost, molarly equal to the quantity of formaldehyde.

During use the quantity of formaldehyde gradually decreases but when the bath is replenished this quantity must be brought to the original level again.

The invention will now be further explained with reference to a few embodiments. The formaldehyde-addition products in the copper plating baths in accordance with the invention may have one of the following formulae for their anions:

| | |
|---|---|
| $HO-CH_2-\overset{H}{N}-CH_2-COO^-$ | glycineformaldehyde (Ex 1, 2, 3, 7) (hydroxymethylaminoacetate) |
| $HO-CH_2-\overset{H}{N}-\overset{H}{C}(CH_3)-COO^-$ | α-alanine-formaldehyde (Ex 4) (hydroxymethylaminopropionate-1) |
| $HO-CH_2-\overset{H}{N}-\overset{H}{N}-CH_2-CH_2-COO^-$ | β-alanine-formaldehyde (Ex 4) (hydroxymethylaminopropionate-2) |
| $HO-CH_2-\overset{H}{N}-\overset{H}{C}(CH_2OH)-COO^-$ | serine-formaldehyde (Ex 4) |
| $HO-CH_2-\overset{H}{N}-(CH_2)_3-COO^-$ | 4-amino propanecarboxylate-formaldehyde |
| $HO-CH_2-\overset{H}{N}-CH_2-SO_3^-$ | aminomethane sulfonate-formaldehyde (hydroxymethylaminomethanesulfonate) |
| $HO-CH_2-\overset{H}{N}-CH_2-CH_2-SO_3^-$ | 2-aminoethanesulfonate-formaldehyde Ex VI (hydroxymethylaminoethanesulfonate) |
| $HO-CH_2\overset{H}{N}-CH_2-CH_2-PO_3H^-$ | 2-aminoethanephosphonate-formaldehyde (hydroxymethylaminoethanephosphonate |
| $HO-CH_2-\overset{H}{N}-CH_2-PO_3H^-$ | aminomethanephosphonate-formaldehyde (hydroxymethylaminomethanephosphonate) |
| $HO-CH_2-\overset{H}{N}-\overset{H}{C}(COO^-)-CH_2-C_6H_5$ | phenylalanine-formaldehyde. (hydroxymethylamino 2-phenylpropionate-1 |
| $HO-CH_2-\overset{H}{N}-\overset{H}{C}(COO^-)-CH_2-C_6H_4-OH$ | tyrosine-formaldehyde |
| $HO-CH_2-\overset{H}{N}-\overset{H}{C}(COO^-)-CH_2CH_3$ | α-aminobutyrate-formaldehyde. |
| $HO-CH_2-\overset{H}{N}-\overset{H}{C}(COO^-)-CH_2-\overset{H}{C}(CH_3)_2$ | loucine-formaldehyde. |

EXAMPLE 1

Glass plates, roughened on one side with carborundum were activated for the electroless copper deposition by moving them first for 2 minutes at ambient temperature in a solution of 50 g tin (II) chloride and 10 ml of a concentrated hydrochloride acid solution in 1 liter of deionised water, by keeping them for 15 seconds in deionized running water, by moving them for 1 minute in a solution of 0.25 g $PdCl_2$ and 10 ml of a concentrated HCl solution in one liter of dionised water and by finally moving them again for half a minute in deionized running water. These operations were repeated a second time wherein the glass plates were moved for 45 seconds in the tin (II) chloride solution and for 30 seconds in the $PdCl_2$ solution. Thereafter the glass plates were processed for a further 30 seconds with an aqueous solution of 50° C. which contains per liter 0.10 mole NaOH and 0.10 mol formaldehyde and immediately thereafter rinsed for 15 seconds in deionised water of 50° C. The plates nucleated in this manner were thereafter subjected to electroless plating in a solution which was heated to 60° C. and which contains the following constituents per liter:

0.06 mole $CuSO_4.5H_2O$ 0.066 mole tetrasodiumsalt of ethylenediaminetetraacetic acid 0.15 mole potassium hydroxymethylamino acetate (the potassium salt of an addition product of formaldehyde and glycine) and approximately 0.10 mole NaOH to pH 12.5.

After 5½ hours approximately 13 μm of copper was deposited on the glass plate. The ductility of the deposited copper layer was 2½ bends. If instead of 0.15 mole of the addition product 0.15 mole of free formaldehyde was added (the pH was 12.5 again) the solution was unstable and brittle copper was deposited on the glass plate.

EXAMPLE II

Glass plates which were nucleated in accordance with example I were strengthened at 50° C. in a solution (A) which contains per liter:

0.06 mole $CuSO_4.5H_2O$ 0.066 mole tetrasodiumsalt of ethylenediaminetetraacetic acid approximately 0.10 mole NaOH to adjust the pH to 12.6

0.10% by weight of the polyoxy compound "Triton" $QS_{44}$ 0.15 mole potassium hydroxymethylamino acetate.

"Triton" $QS_{44}$ is an anionic phosphate ester having approximately 8 ethyleneoxide groups (molar weight approximately 800), and is supplied by Rohm and Haas. The addition product is added in the form of a 3.5 mole aqueous solution of pH 12.8. After 6 hours approximately 11 μm of copper had been deposited on the glass plate. The ductility of the copper layer was 4 bends. For comparison a solution (B) was made in which the addition product was replaced by a concentration of free formaldehyde of 0.02 mol/l so that the rate of deposition during one hour had the same value and which, as regards the other constituents of the bath was identical to the above solution. With both solutions, each in a volume of 200 ml, one solution having a addition product of formaldehyde and glycine, the other having free formaldehyde, copper was deposited on nucleated glass plates in accordance with example I (surface area 5.9 $cm^2$) at a temperature of 50° C. for various working days of 6 hours each. After each day the quantity of cupric ions used up was determined and added again. After the original pH was adjusted copper was thereafter again deposited on new nucleated glass plates. In this manner the exhaustion as regards formaldehyde could be studied. The quantities of copper per hours deposited with the two solutions had the following values:

| | solution A | solution B |
|---|---|---|
| 1st day | 1.3 mg/cm² hour | 1.3 mg/cm² hour |
| 2nd day | 1.1 mg/cm² hour | 0.5 mg/cm² hour |
| 3rd day | 1.1 mg/cm² hour | 0.15 mg/cm² hour |

EXAMPLE III

Nucleated glass plates in accordance with example I were electroless copper plated at a temperature of 52° C. in solutions which contained per liter the following constituents:

0.06 mole $CuSO_4.5H_2O$ 0.066 mole tetrasodiumsalt of ethylenediaminetetraacetic acid NaOH to the required pH In the following table there are shown (A) Varying concentrations in mole/l of potassium hydroxymethylamino acetate (B) Varying concentrations of mole/l of free formaldehyde.

The quantities of copper deposited per hour were as follows:

| Conc. A | pH 12,4 | pH 12,6 | Conc. B | pH 12,4 |
|---|---|---|---|---|
| 0,10 | 3,4 mg/cm². hour | 4,0 mg/cm². hour | 0,01 | 0,4 mg/cm². hour |
| 0,20 | 3,6 mg/cm². hour | 4,6 mg/cm². hour | 0,02 | 2,4 mg/cm². hour |
| 0,30 | 3,6 mg/cm². hour | 4,7 mg/cm². hour | 0,03 | 3,7 mg/cm². hour |
| 0,50 | 3,5 mg/cm². hour | 4,7 mg/cm². hour | 0,04 | 4,7 mg/cm². hour |

The results show that contrary to the use of free formaldehydethe hydroxymethylaminopotassium acetate results in substantially stable rates of deposition over a large concentration area, which is of great importance for practical use.

EXAMPLE IV

Glass plates which had been activated in the same manner as in example I were electroless copper plated in solutions which contain the following constituents per liter:

(A)

0.06 mole $CuSO_4.5H_2O$ 0.066 mole tetrasodiumsalt of ethylenediaminetetraacetic acid 0.10 mole NaOH (B)

solution A+0.13 mole addition product of β-alanine and formaldehyde (K-salt)

(C)

solution A+0.13 mole addition product of α-alanine and formaldehyde (K-salt)

+0,10% per weight of polyoxyethylene compound "Triton" $QS_{30}$ (Rohm and Haas), an anionic acid phosphate ester, (D)

solution A+0.10 mole addition product of serine and formaldehyde (K-salt)

+0.10 wt. % "Triton" $QS_{30}$.

Some data as regards pH and temperature of the solutions and the results obtained are as follows:

| | sol. B | sol. C | sol. D |
|---|---|---|---|
| pH | 12,9 | 12,8 | 12,8 |
| temperature | 60° C. | 52° C. | 52° C. |
| deposite thickness after 5 hours | 9 μm | 15 μm | 13 μm |
| ductility | >3 bends | 1 bend | 2 bends |

EXAMPLE V

Nucleated glass plates according to example I were plated in solutions having varied concentrations in (free) formaldehyde and glycine and which also contain the following constituents per liter: (temperature 52° C.):

0.06 mole $CuSO_4.5H_2O$
0.066 mole tetrasodiumsalt of ethylenediaminetetraacetic acid
0.10 mole NaOH
0.10 % by weight of polyoxyethylene compound "Triton" $QS_{44}$
X mole (free) formaldehyde
Y mole glycine.

The pH of the solution was kept constant in all cases (approximately 12.8). The results are shown in the table herebelow:

| | | | | | | |
|---|---|---|---|---|---|---|
| x | 0,10 | 0,10 | 0,10 | 0,15 | 0,15 | 0,15 |
| Y | — | 0,05 | 0,10 | 0,05 | 0,10 | 0,15 |
| deposit thickness μm after 5 hours | appr. 20 | ca. 15 | ca. 8 | ca. 16 | ca. 3 | ca. 9 |
| ductility | brittle | 1½ b | >3 b | ½ b | 1½ b | >3 b |

EXAMPLE VI

Nucleated glass plates according to example I were electroless copper plated at a temperature of 52° C. in a solution which contained per liter:

0.06 mole $CuSo_4.5H_2O$
0.066 mole tetrasodiumsalt of ethylenediaminetetraacetic acid
0.10 mole NaOH
0.15 mole hydroxymethylaminoethanesodium sulphonate (addition product of formaldehyde and 2-aminoethanesodium sulphonate)

After 6 hours approximately 13 μm of copper had been deposited which had a ductility of at least 2 bends.

EXAMPLE VII

Nucleated glass plates according to example I were electroless copper plated at a temperature of 50° C. in a solution which contained the following constituents for each liter:

0.02 mole $CuSO_4.5H_2O$
0.10 mole triethanolamine
0.40 mole NaOH
0.10 mole potassium hydroxymethylamino acetate
0.20 % per weight of polyalkaleneglycol "Pluronic" F 108 of Wyandotte Chemical Corporation.

After 5 hours 15 μm copper had been deposited on the glass plate. The ductility amounted to 2 bends. If "Pluronic F 108" was replaced by 0.025 % by weight of a thio-ether ($C_{12}H_{25}$—S—) of "Pluronic F 108" then the stability of the solution was increased whilst now 12 μm of copper was deposited which had a ductility of 4 bends.

What is claimed is:

1. In an aqueous electroless copper plating bath comprising cupric ions, at least one compound capable of forming watersoluble complexes with cupric ions, alkali for maintaining the pH of said bath from about 12 to 13, a formaldehyde yielding compound reducing agent; the improvement consisting of an addition product of formaldehyde and an alkali metal salt of an amino acid containing at least one free —$NH_2$ group selected from the group consisting of aminoalkanecarboxylic acids and aminoalkanesulfonic acids free of bivalent sulfur, said addition product having substantially equimolar quantities of formaldehyde and amino acid salt.

2. A copper plating bath according to claim 1, containing ethylenediaminetetrasodium acetate as a complexing agent for cupric ions and glycine as the amino-acid.

3. A method of preparing the bath of claim 1 wherein the amino acid salts and the formaldehyde are separately added to the bath.

4. The copper plating bath of claim 1 wherein a polyoxy ethylene oxide is also present.

* * * * *